United States Patent [19]

Klefisch

[11] Patent Number: 4,669,978

[45] Date of Patent: Jun. 2, 1987

[54] HEAT TREATING BASKET

[76] Inventor: Rudolf Klefisch, Siebengebirgsallee 165, D-5000 Cologne 41, Fed. Rep. of Germany

[21] Appl. No.: 832,329

[22] Filed: Feb. 24, 1986

[30] Foreign Application Priority Data

Mar. 2, 1985 [DE] Fed. Rep. of Germany ..... 3507439

[51] Int. Cl.[4] ..... F27D 1/00; C21D 9/00

[52] U.S. Cl. ..... 432/261; 432/253; 220/19; 220/83

[58] Field of Search ..... 432/261, 253; 34/237; 220/83, 19

[56] References Cited

U.S. PATENT DOCUMENTS

| | | | |
|---|---|---|---|
| 2,296,380 | 9/1942 | Davidson | 432/261 |
| 2,453,511 | 11/1948 | Jackson | 432/261 |
| 3,315,835 | 4/1967 | Katzman | 220/19 |
| 3,498,597 | 3/1970 | Roberts et al. | 432/261 |
| 4,050,604 | 9/1977 | Flanders | 220/83 |
| 4,290,753 | 9/1981 | Klefisch | 432/261 |
| 4,463,864 | 8/1984 | Roach | 432/261 |
| 4,576,300 | 3/1986 | Kedziov | 220/83 |

FOREIGN PATENT DOCUMENTS

| | | | |
|---|---|---|---|
| 2817718 | 5/1985 | Fed. Rep. of Germany . | |
| 660124 | 10/1948 | United Kingdom | 220/19 |

*Primary Examiner*—Henry C. Yuen

*Attorney, Agent, or Firm*—Birch, Stewart, Kolasch & Birch

[57] ABSTRACT

A heat treating basket which comprises a bottom section having upwardly extending post members provided with first connecting means, upper frame members having second connecting means associated therewith, said bottom section being connected to said upper frame members through the slidable engagement of said first and second connecting means, and lugs provided at the first and second connecting means to prevent the disengagement of the upper frame members from the bottom section.

7 Claims, 4 Drawing Figures

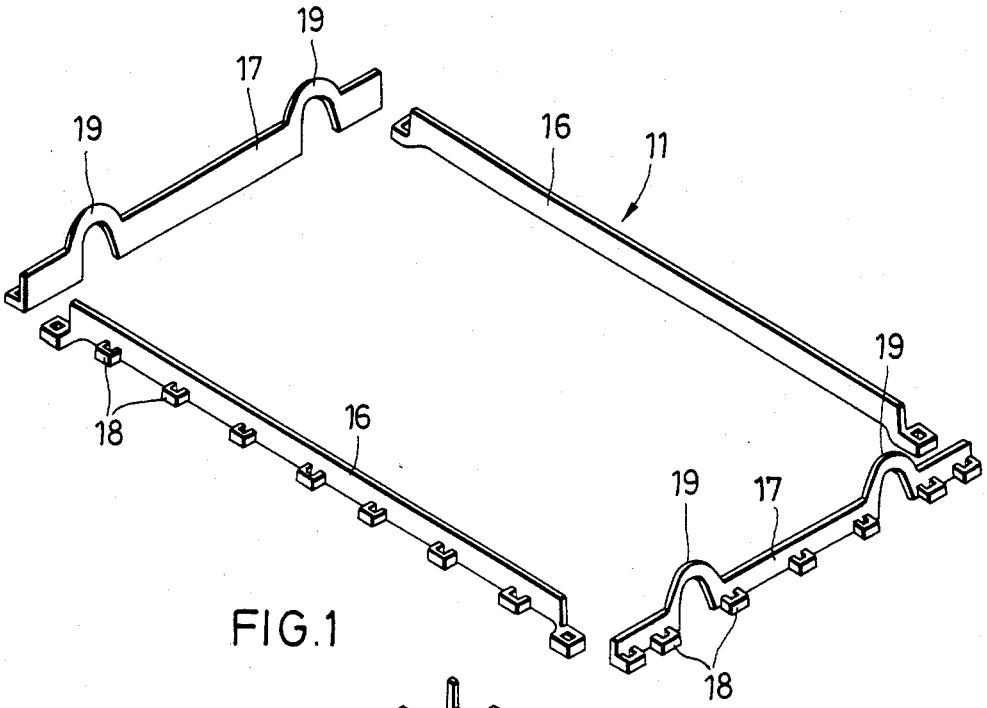
FIG.1
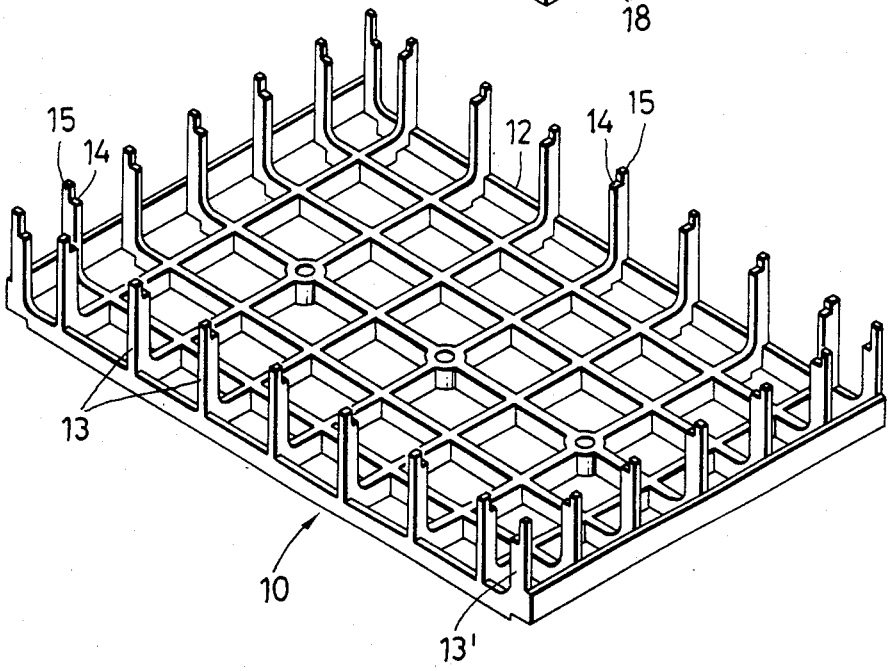

HEAT TREATING BASKET

BACKGROUND AND SUMMARY OF THE INVENTION

The present invention relates to a heat treating basket comprising a closed or grate-shaped bottom containing upright posts with end pins integrally formed with rims and a frame resting on said posts and undetachably fixed thereto via flexible eye connections through which the pins protrude. A lug prevents the eye connection from sliding off the pins.

Heat treating baskets for the passage of material through annealing furnaces and for quenching hot material in a quenching bath are subjected to high temperature fluctuations and local differences in temperatures so that they suffer from high thermal stress, with the maximum thermal stress occurring at the frame which forms the upper rim of the heat treating basket.

In a known heat treating basket of the above mentioned type (German laid open patent application No. 28 17 718), the bottom together with the upright posts integrally formed thereto is a casting of one piece. The frame produced separately and seated in grooves at the upper ends of the posts is fixed to the posts by means of eyes or small framings which project downwardly from outside the frame to engage the lugs of the posts. When the frame is manufactured, only two bars are cast for each eye, the third bar closing the eye being applied later by welding to form the final element after the frame has been set on the ends of the posts. Due to the welding of the final elements, two welding spots at each eye and, furthermore, foreign material for the final element are required, with a resultant high expenditure in manual finish and production costs.

Accordingly, it is the object of the present invention to provide an improved heat treating basket of the foregoing type with simplified manufacturing techniques.

The problem is solved, according to the present invention, in that the eyes are integrally cast to the posts or to the frame and are aligned horizontally and the lugs are welded to the vertically extending pins.

In the heat treating basket of the present invention, the eyes are not completed by a final element in a later manufacturing step, but they are integrally formed to the bottom or frame during the casting step. When the frame is assembled to the ends of the posts of the bottom, the vertical pins are inserted into the horizontal eyes. Subsequently, by welding the lugs to the pin ends protruding through the eyes, the system is locked. One sole welding operation is necessary only to lock each eye connection. Preferably, the lugs consist of welding spots produced by using a welding material. No foreign material is needed in addition to the welding material, and the welding spots may be simply realized by selectively applying a welding electrode to the pins. The welding spots are spaced from the eye which should not be clamped so as to maintain the expansion mobility of the eye connection.

Preferably, the eyes are integrally formed to the frame, while inside portions of the post are provided with horizontal bases for supporting the frame which, towards the basket inside, are not limited by upright elements, thus allowing frame movements relative to the bottom or to the posts. Further, the inside of the frame is substantially flush with the inner post boundaries so that a wire grid mounted in the heat treating basket cannot be deflected at the transition between the posts and the frame.

The upper frame which may be made in one piece suitably consists of separate frame bars. In such a case, the latter may move and expand themselves independently from one another. Further, it is easier to produce the frame bars in separate casing molds than as a single-part frame. According to a preferred further embodiment of the invention, the posts at the corners of the bottom traverse two eyes of the two adjacent frame posts, with the two eyes being arranged at different heights. This permits, in case of a multipart frame, a simple corner connection design.

The heat treating basket of the present invention is not only favorably characterized by a simple construction but also by the fact that it can be stacked and displayed on the furnace floor. The play in all directions and the expansion mobility between bottom and frame are ensured by the eye connections which are provided.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view of a bottom and of the upper frame to be secured thereto which consists of individual frame bars;

DETAILED DESCRIPTION OF THE INVENTION

Figure 2:
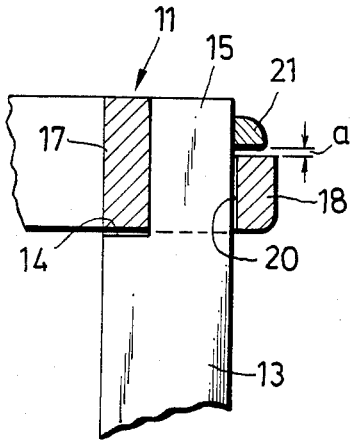
FIG. 2 is a section of an eye connection for a heat treating basket according to FIG. 1.

The heat treating basket of the present invention contains a bottom 10 and an upper frame 11. The bottom 10 is made of a plane bottom grating 12 formed of one piece and consisting of intersecting grid rods and upright vertical posts 13 provided at the rim of the bottom grating and passing over into the respective grid rods thereof. The inside of each post 13 includes a horizontal base 14 limited externally by an upright pin 15 and freely extending towards the interior of the heat treating basket where it is not confined by upright elements.

The bases 14 of the posts 13 are designed to receive the upper frame 11 which, just like the bottom 10 is of a rectangular shape and contains two longitudinal frame bars 16 and two transverse frame bars 17, said frame bars 16 and 17 being separate castings. Each of the frame bars consists of a strip in upright position from which, near the lower edge, a plurality of eyes 18 project externally in the horizontal direction, thus forming vertical passage apertures. The rectangular eyes 18 are limited at one side of the strip of the respective frame bar 16 or 17, while their three remaining sides have a U-shaped configuration which, together with the frame bars, form the hole 20. The height of each eye is about one-half the height of the strip of the frame bar.

The transverse frame bars 17 contain two handles 19 integrally formed therein.

As evident from FIG. 2, the underside of each frame bar 17 is positioned on the horizontal bases 14 of the posts 13, whereby the insides of the posts 13 are in flush with the inside of the frame bars 16 or 17. In other words, the thickness of the frame bar 17 approximately corresponds to the width of the base 14. As compared to the cross section of pin 15 which forms the upper end of the post 13, the hole 20 of the eye 18 is oversized. The pin 15 extends through the hole 20. Since the pin 15 is nearly as high as the frame bar 17, the upper side of the pin 15 is flush with the frame bar 17.

To inhibit the removal of the frame bar 17 from the post 13, a lug 21 in the form of a welding spot is provided at the portion of the pin 15 which projects out of the eye 18. To safeguard the required expansion mobility, the lug 21 is provided at a distance a from the upper side of the eye. To maintain said distance a, a spacer may be placed on the upper side of eye 18 during the production of the welding spot 21. The spacer is subsequently removed.

Figure 3:
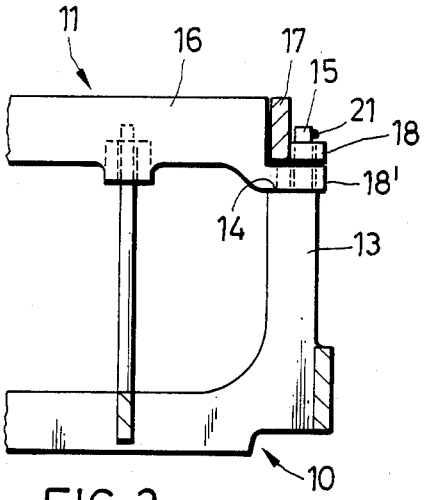
FIG. 3 is a view of a corner connection of a heat treating basket according to FIG. 1.

FIG. 3 shows a corner connection of frame 11 of the heat treating basket. The base 14 at the respective post 13' is positioned more deeply than in the case of the remaining posts. The end of the frame bar 16 is provided with a downward extension including an eye 18' which rests on the base 14. On the eye 18' , there is placed the transverse frame bar 17 with the eye 18. Thus, the pin 15 penetrates both eyes 18 and 18'.

Figure 4:
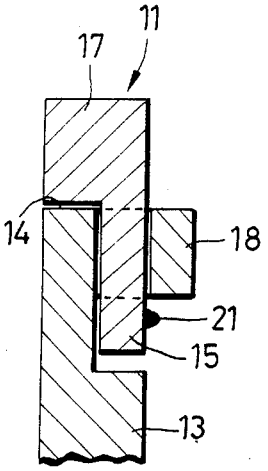
FIG. 4 is a section of another embodiment of the eye connection.

In the embodiment shown in FIG. 4, the eyes 18 are integrally formed to the posts 13, while the pins 15 which extend vertically through the eye 18 project downwardly from the frame bar 17. The end of the pin 15 which projects downwardly from the eye 18 is provided with the lug 21 subsequently applied in the form of a welding spot. The base 14 of this embodiment is at the upper end of post 13.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heat treating basket which comprises a bottom section containing a plurality of integrally formed, upwardly extending post members provided with first connecting means, said post members being disposed along the periphery of said bottom section upper frame members containing a plurality of peripherally disposed second connecting means, said bottom section being connected to said upper frame members through the slidable engagement of said first and second connecting means, and lugs provided at the first and second connecting means to prevent disengagement of the upper frame members from the bottom section, said lugs being spaced apart from the engaging first and second connecting means to provide for expansion mobility of the respective elements.

2. The heat treating basket according to claim 1 wherein the lugs are welding spots.

3. The heat treating basket according to claim 1 wherein the second connecting means are eye members integrally attached to the frame members and the first connecting means are pin means provided at the end of the post members, said pin means slidably extending into said eye members.

4. The heat treating basket according to claim 1 wherein the second connecting means are pin means integrally attached to the frame members and the first connecting means are eye members provided on the post members, said pin means slidably extending into said eye members.

5. The heat treating basket according to claim 3 wherein the inside upper portions of the post members are provided with notched out horizontal bases for receiving the eye members of the frame members.

6. The heat treating basket according to claim 1 wherein the frame members consists of separate frame bars.

7. The heat treating basket according to claim 6 wherein the eye members at the ends forming the corners of the upper frame members overlap and the post members have pin means which slidably extend into said overlapping eye members.

* * * * *